United States Patent [19]

Petrachonis et al.

[11] 4,288,073

[45] Sep. 8, 1981

[54] EXERCISE BAR

[76] Inventors: Frank Petrachonis; Felix Petrachonis, both of 411 W. Chester St., Shenandoah, Pa. 17976

[21] Appl. No.: 105,212

[22] Filed: Dec. 19, 1979

[51] Int. Cl.[3] ..... A63B 13/00

[52] U.S. Cl. ..... 272/123

[58] Field of Search ..... 272/116, 117, 122, 123, 272/118, 134, 144, 93; D21/197

[56] References Cited

U.S. PATENT DOCUMENTS

| | | | |
|---|---|---|---|
| 460,270 | 9/1891 | Somerby | 272/122 |
| 2,508,567 | 5/1950 | Dymeck | 272/123 |
| 2,722,419 | 11/1955 | Tarapczynski | 272/123 |
| 3,679,107 | 7/1972 | Perrine | 272/123 X |
| 3,708,167 | 1/1973 | Potgieter | 272/117 |
| 4,200,280 | 4/1980 | Goodwin | 272/118 |

OTHER PUBLICATIONS

"Marcy" Physical Fitness Equipment Catalog No. 69; Oct. 1969; pp. 9 and 20.

*Primary Examiner*—Richard J. Apley

[57] ABSTRACT

An exercise bar, for use by weight lifters in performing wide grip bench presses, which comprises a straight horizontally elongated relatively long central section of uniform diameter. The bar also employs two like straight downwardly and outwardly extending short inclined sections. The diameter of the inclined sections is equal to that of the central section. The inclined and central sections lie in a common plane. The upper end of each inclined section is integral with a corresponding end of the central section. Each inclined section intersects the central section with a like included angle. Each inclined section is adapted to be grasped by a corresponding one of the hands of the lifter when the bar is in use. The bar also employs two like straight horizontally elongated end sections of intermediate length which fall along a corresponding horizontal line and lie in the common plane. One end of each end section is integral with the lower end of the corresponding inclined section. The end sections extend outwardly from the inclined sections. The diameter of the end sections is equal to that of the central section. Each end section is adapted to have weights secured thereto when the bar is in use.

2 Claims, 3 Drawing Figures

EXERCISE BAR

THE PRIOR ART

U.S. Pat No. 2,722,419 shows an exercising device which appears similar to that of applicants. U.S. Pat. No. 3,679,107, FIG. 6, shows a weight lifting yoke which appears similar to that of applicants. As will be explained below, this similarity is only apparent since these prior art inventions are actually differ both in structure and function as compared to the invention of applicants.

BACKGROUND OF THE INVENTION

Weight lifters and other individuals who exercise using weights often practice what is called a bench press. The individual so engated lies flat on a bench, grasps a bar having weights at each end and first extends his arms straight upward to hold the weighted bar above his chest and then lowers the bar until it rests upon his chest. In this exercise the individual's wrists extend at right angles to the bar.

In order to exercise certain additional muscles, this exercise can be varied by modifying it into a wide grip bench press. In this modification, the user spreads his arms outward so that the separation of the hands is increased and the wrists are no longer disposed at right angles to the bar but rather the center line of each wrist intersects the bar at an acute angle. In the bench press, the arms are disposed at right angles to the shoulder. In the wide bench press the arms extend outward beyond the shoulder. Under these conditions, when the bar is raised, the wrists are subject to very severe strain and the weights on the bar must be reduced as compared to the weights used during a bench press wherein the strain is more upon the arms and less upon the wrists.

In this invention, the bar geometry is changed in such manner that the user can perform wide grip bench presses while the wrists are disposed at right angles to the portions of the bar held in the hands. This arrangement greatly reduces the wrist strain and enables the user to perform wide grip bench presses with much heavier weights and the desired muscle exercise is greatly enhanced.

SUMMARY OF THE INVENTION

In accordance with the principles of this invention, an exercise bar for use by weight lifters in performing wide grip bench presses employs a straight horizontally elongated relatively long central section of uniform diameter. The bar also employs two like straight downwardly and outwardly extending short inclined sections. The diameter of the inclined sections is equal to that of the central section. The inclined and central sections lie in a common plane with the upper end of each inclined section being integral with a corresponding end of the central section. Each inclined section intersects the central section with a like included angle and is adapted to be grasped by a corresponding one of the hands of the lifter when the bar is in use. In addition, the bar also employs two like straight horizontally elongated end sections of intermediate length which fall along a corresponding horizontal line and lie in said common plane. One end of each end section is integral with the lower end of the corresponding inclined section, said end sections extending outwardly from the inclined sections. The diameter of the end sections is equal to that of the central section. Each end section is adapted to have weights secured thereto when the bar is in use.

When this bar is used for wide bench presses, the wrists of the user are always disposed essentially at right angles to the inclined sections whereby wrist strain is minimzed. Moreover, when the bar is lowered to rest upon the chest of the user, the hands are disposed on each side of the chest below the bar, instead of resting at the chest when the conventional straight bar is used. This lower hand position provides additional desired muscular exercise.

In view of the above explanation, it will be seen that the central portion of the bar shown in U.S. Pat. No. 2,722,419 is curved and lowered whereby this known bar cannot be used for bench presses. Moreover, since this known bar is curved for head clearance, its central portion is too short to span the chest of the user.

Moreover, the bar shown in FIG. 6 of U.S. Pat. No. 3,679,107 is designed to be used with a yoke that is mounted upon the shoulders of a human being for lifting and carrying a weight. The bar which carries weights is bent to position the weights below the shoulders of the weight lifter while distributing the weight on the shoulders and along the back of the end of the spinal column. THe weights are positioned over and bear upon the muscle parts of the shoulder. The inclined sections of the bar are too long and too closely spaced to permit this bar to be used for wide bench presses.

DETAILED DESCRIPTION OF PREFERRED EMBODIMENTS

Figure 1:
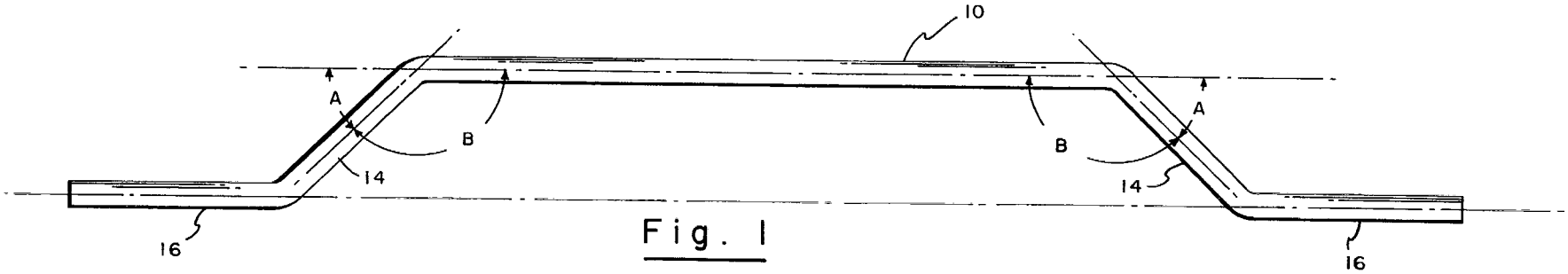
FIG. 1 is a side view of the exercise bar in accordance with the invention with the weights removed.
Figure 2:
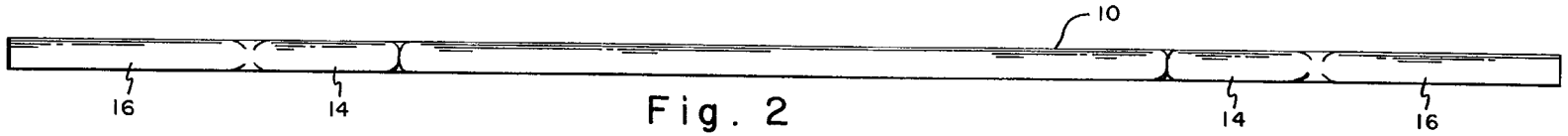
FIG. 2 is a top view of the bar of FIG. 1.
Figure 3:
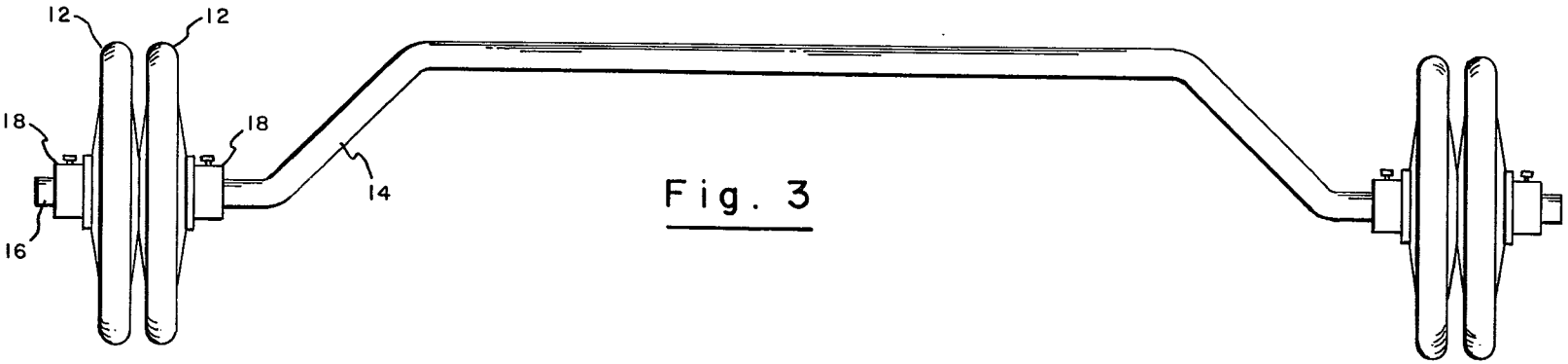
FIG. 3 is a detail side view illustrating an end portion of the bar of FIGS. 1 and 2 with weights removably attached.

Referring now to FIGS. 1-3, a metal bar typically of steel or iron has a straight central section 10 having a uniform circular cross section. The diameter of this section will fall in the appropriate range of 1 to 1⅛ inches and typically is 1 1/16 inches The diameter must be large enough to prevent the bar from bending regardless of the size and number of weights 12 removably secured thereto by a user and should be consistent with existing weight lifting bar diameters to allow for a free interchange of commonly used weights.

The central section must be long enough to span the chest of a user during wide grip bench press exercises and should be short enough to enable the user to use it in the manner previously described without undue wrist strain. The length of this section will fall within the approximate range 30 to 39 inches and typically is 33 inches.

Each of two like straight downwardly and outwardly extending short inclined section 14 having the same diameter as section 10 be in a common plane with section 10. The upper end of each section 14 is integral with a corresponding end of section 10. Each section 14 is adapted to be grasped by a corresponding one of the hands of the lifter when the bar is in use. Each inclined section should be long enough to be grasped in the hand, but should not be so long as to enable the user to accidentally place his hands in improper position. The length of each inclined section will fall within the approximate range of 4 to 5 inches and typically is 4.5 inches.

It will be seen that each inclined section intersects a corresponding end of the straight section at a like included angle B and a like external angle A, the sum of angles A and B being one hundred and eighty degrees. Since the wrists of any user can easily adjust to an angle plus or minus five degrees, as compared to an optimum angle of ninety degrees when sections 14 are grasped, a range of angles can be used. The included angle B will fall within the approximate range 160 to 151 degrees and typically is 157 degrees. Consequently, the external angle A will fall within the approximate range 20 to 29 degrees and typically is 23 degrees.

The angle A is computed by subtracting the quantity ten from the length of the central section in inches to find the answer in degrees.

Thus the formula is:

$$\text{Angle A (degrees)} = \text{length of section (inches)} - 10 .$$

Since the sum of angles A and B is equal to 180 degrees:

$$\begin{aligned} \text{Angle } B \text{ (degree)} &= 180 - \text{angle } A \\ &= 190 - \text{length of section (inches)} \end{aligned}$$

Each of two like straight horizontally elongated end sections 16 falls along a common horizontal line parallel to section 10 and falls in the same common plane. These sections have the same diameter as sections 10 and 14. One end of each section 16 is integral with the lower end of the corresponding section 14 and sections 16 extend outward in opposite directions. Each section 16 is adapted to receive removable weights 12 held detachably thereon by collars 18.

Each section 16 should be long enough to hold the maximum number of weights desired but should not be so long as to make the bar difficult to use. The length of each section 16 will fall within the approximate range 12 to 16 inches and typically is 15 inches.

Although the invention has been described with particular reference to the drawings, the protection sought is to be limited only by the terms of the claims which follow.

We claim:

1. An exercise bar for use by weight lifters in performing wide grip bench presses, said bar comprising:

a straight horizontally elongated relatively long central section of unifrom diameter, the length of said central section falling within the approximate range 30 to 39 inches;

two like straight downwardly and outwardly extending short inclined sections, the diameter of the inclined sections being equal to that of the central section, said inclined and central sections lying in a common plane, the uper end of each inclined section being integral with and directly adjacent to a corresponding end of the central section, each inclined section intersecting the central section with a like included angle, the included angle falling within the approximate range 151 to 160 degrees, each inclined section being adapted to be grasped by a corresponding one of the hands of the lifter when the bar is in use, the length of each inclined section falling within the approximate range 4 to 5 inches; and two like straight horizontally elongated end sections of intermediate length falling along a corresponding horizontal line and lying in said common plane, one end of each end section being integral with and directly adjacent to the lower end of the corresponding inclined section, said end sections extending outwardly from the inclined sections, the diameter of the end sections being equal to that of the central section, each end section being adapted to have weights secured thereto when the bar is in use, the length of each section falling within the approximate range 12 to 16 inches.

2. The bar of claim 1 wherein said diameter falls within the approximate range 1 to $1\frac{1}{8}$ inches.

* * * * *